US009045296B2

(12) United States Patent
Matsumoto

(10) Patent No.: US 9,045,296 B2
(45) Date of Patent: Jun. 2, 2015

(54) CONVEYING DEVICE AND IMAGE FORMING APPARATUS

(71) Applicant: Tohru Matsumoto, Kanagawa (JP)

(72) Inventor: Tohru Matsumoto, Kanagawa (JP)

(73) Assignee: RICOH COMPANY, LIMITED, Tokyo (JP)

( * ) Notice: Subject to any disclaimer, the term of this patent is extended or adjusted under 35 U.S.C. 154(b) by 0 days.

(21) Appl. No.: 14/267,069

(22) Filed: May 1, 2014

(65) Prior Publication Data

US 2014/0232060 A1 Aug. 21, 2014

Related U.S. Application Data

(62) Division of application No. 13/768,282, filed on Feb. 15, 2013, now Pat. No. 8,851,470.

(30) Foreign Application Priority Data

Feb. 17, 2012 (JP) ..... 2012-032425
Jul. 23, 2012 (JP) ..... 2012-162265

(51) Int. Cl.

| | |
|---|---|
| ***B65H 7/02*** | (2006.01) |
| ***B65H 7/10*** | (2006.01) |
| ***B65H 9/10*** | (2006.01) |
| ***B65H 9/20*** | (2006.01) |
| ***B65H 5/06*** | (2006.01) |

(Continued)

(52) U.S. Cl.

CPC .. *B65H 7/02* (2013.01); *B65H 7/10* (2013.01); *B65H 9/10* (2013.01); *B65H 9/20* (2013.01); *B65H 5/062* (2013.01); *B65H 5/26* (2013.01); *B65H 9/06* (2013.01); *B65H 9/106* (2013.01); *B65H 2404/144* (2013.01); *B65H 2404/6111* (2013.01); *B65H 2601/523* (2013.01); *B65H 2801/09* (2013.01); *B65H 9/002* (2013.01)

(58) Field of Classification Search

CPC ..... B65H 9/002; B65H 9/10; B65H 9/103; B65H 9/106; B65H 9/20; B65H 2220/15
USPC ..... 271/228, 252
See application file for complete search history.

(56) References Cited

U.S. PATENT DOCUMENTS 5,219,159 A 6/1993 Malachowski et al.
5,273,274 A 12/1993 Thomson et al.

(Continued)

FOREIGN PATENT DOCUMENTS

JP 2008-050069 A 3/2008
JP 2013-166648 A 8/2013

*Primary Examiner* — David H Bollinger
(74) *Attorney, Agent, or Firm* — Harness, Dickey & Pierce, P.L.C.

(57) ABSTRACT

A conveying device includes a pair of first nipping rollers configured to be movable in a width direction while nipping a recording medium and rotate to convey the recording medium; a pair of second nipping rollers configured to be movable in the width direction while nipping the recording medium and rotate to convey the recording medium, the pair of second nipping rollers being arranged on an upstream side of the first nipping rollers in a conveying path; and a detecting unit configured to detect an amount of positional deviation in the width direction of the recording medium being conveyed in the conveying path. The pair of first nipping rollers is moved in the width direction based on a detection result of the detecting unit while the pair of first nipping rollers nips the recording medium so that a positional deviation of the recording medium in the width direction is corrected.

10 Claims, 4 Drawing Sheets

(51) Int. Cl.

| | |
|---|---|
| ***B65H 5/26*** | (2006.01) |
| ***B65H 9/06*** | (2006.01) |
| ***B65H 9/00*** | (2006.01) |

(56) References Cited

U.S. PATENT DOCUMENTS

| | | | | |
|---|---|---|---|---|
| 6,019,365 | A * | 2/2000 | Matsumura | 271/227 |
| 6,059,285 | A * | 5/2000 | Suga et al. | 271/228 |
| 6,273,418 | B1 * | 8/2001 | Fujikura et al. | 271/228 |
| 7,243,917 | B2 | 7/2007 | Knierim et al. | |
| 7,658,379 | B2 * | 2/2010 | Yasumoto | 271/251 |
| 7,753,370 | B2 * | 7/2010 | Inoue | 271/239 |
| 7,837,193 | B2 * | 11/2010 | Mandel et al. | 271/249 |
| 7,900,917 | B2 * | 3/2011 | Fujiwara et al. | 271/265.04 |
| 8,205,878 | B2 * | 6/2012 | Masuda | 271/249 |
| 8,382,104 | B2 * | 2/2013 | Yasumoto | 271/251 |
| 8,851,470 | B2 * | 10/2014 | Matsumoto | 271/228 |
| 2008/0232879 | A1 | 9/2008 | Shoji et al. | |
| 2008/0240821 | A1 | 10/2008 | Shoji et al. | |
| 2010/0301545 | A1 | 12/2010 | deJong et al. | |
| 2011/0089623 | A1 | 4/2011 | Kato et al. | |
| 2011/0148033 | A1 | 6/2011 | Williams et al. | |
| 2011/0291352 | A1 | 12/2011 | deJong et al. | |
| 2013/0082441 | A1 | 4/2013 | Banal et al. | |
| 2013/0214482 | A1 | 8/2013 | Matsumoto | |

* cited by examiner

CONVEYING DEVICE AND IMAGE FORMING APPARATUS

CROSS-REFERENCE TO RELATED APPLICATIONS

This application is a divisional application of and claims priority under 35 U.S.C. §120/121 to U.S. application Ser. No. 13/768,282 filed Feb. 15, 2013, which claims priority under 35 U.S.C. §119 to Japanese Patent Application No. 2012-032425 filed in Japan on Feb. 17, 2012 and Japanese Patent Application No. 2012-162265 filed in Japan on Jul. 23, 2012, the contents of each of which are hereby incorporated herein by reference in their entirety and for all purposes.

BACKGROUND OF THE INVENTION

1. Field of the Invention

The present invention relates to a conveying device and an image forming apparatus.

2. Description of the Related Art

Conventionally known in image forming apparatuses such as copiers and printers is a technology for correcting a deviation from a correct position in the width direction (the direction perpendicular to a conveying direction) (hereinafter, referred to as "lateral registration") of a recording medium to the correct position (positional deviation correction) (see Japanese Patent Application Laid-open No. 2008-50069, for example).

More specifically, according to the disclosure in Japanese Patent Application Laid-open No. 2008-50069, to correct a longitudinal registration and skew, a recording medium carried by a plurality of pairs of carriage rollers along a conveying path is caused to halt against a stopper (abutting member). A lateral registration of the recording medium is then corrected by moving the recording medium in the width direction while nipping the recording medium held in contact with the stopper between a pair of lateral registration rollers (nipping rollers) positioned on an upstream side of the stopper. Once the lateral registration is corrected, the recording medium is further carried toward an image transfer unit.

Japanese Patent Application Laid-open No. 2008-50069 also discloses a technology in which a linear conveying path or a conveying path with a large curvature radius of 50 millimeters or more is provided on an upstream side of the pair of lateral registration rollers, in order to reduce a conveying resistance of the recording medium along the conveying path on the upstream side of the pair of lateral registration rollers, when the lateral registration is corrected.

Because the technology disclosed in Japanese Patent Application Laid-open No. 2008-50069 reduces the conveying resistance of the recording medium along the conveying path on the upstream side of the pair of lateral registration rollers when the lateral registration is corrected, the technology is expected to prevent the recording medium from skewing or to prevent the lateral registration correction from being reduced in accuracy because of the conveying resistance, advantageously.

However, because the conveying path on the upstream side of the pairs of lateral registration rollers is linear, or is curved at a large curvature radius of 50 millimeters or larger, the size of the entire apparatus is increased.

Therefore, there is a need to provide a conveying device and an image forming apparatus that can correct a lateral registration highly accurately without any defect such as skew of a recording medium caused by a conveying resistance, and without increasing the size of the apparatus.

SUMMARY OF THE INVENTION

It is an object of the present invention to at least partially solve the problems in the conventional technology.

According to an embodiment, there is provided a conveying device for conveying a recording medium along a conveying path. The conveying device includes a pair of first nipping rollers configured to be movable in a width direction while nipping the recording medium and rotate to convey the recording medium; a pair of second nipping rollers configured to be movable in the width direction while nipping the recording medium and rotate to convey the recording medium, the pair of second nipping rollers being arranged on an upstream side of the first nipping rollers in the conveying path; and a detecting unit configured to detect an amount of positional deviation in the width direction of the recording medium being conveyed in the conveying path. The pair of first nipping rollers is moved in the width direction based on a detection result of the detecting unit while the pair of first nipping rollers nips the recording medium so that a positional deviation of the recording medium in the width direction is corrected.

According to another embodiment, there is provided a conveying device for conveying a recording medium along a conveying path. The conveying device includes a pair of first nipping rollers configured to be movable in a width direction while nipping the recording medium and rotate to convey the recording medium; a pair of second nipping rollers configured to be movable in the width direction while nipping the recording medium and rotate to convey the recording medium, the pair of second nipping rollers being arranged on an upstream side of the first nipping rollers in the conveying path; and a detecting unit configured to detect an amount of positional deviation in the width direction of the recording medium being conveyed in the conveying path. The conveying device is switched between a first operation and a second operation based on a thickness of the recording medium. In the first operation, the pair of first nipping rollers and the pair of second nipping rollers being moved in the width direction based on a detection result of the detecting unit while the pair of first nipping rollers and the pair of second nipping rollers nip the recording medium, so that a positional deviation of the recording medium in the width direction is corrected. In the second operation, the pair of first nipping rollers is moved in the width direction is moved based on the detection result of the detecting unit while the pair of first nipping rollers nips the recording medium and the second nipping rollers are separated from each other, so that the positional deviation of the recording medium in the width direction is corrected.

According to still another embodiment, there is provided an image forming apparatus that includes the conveying device according to any one of the above embodiments.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
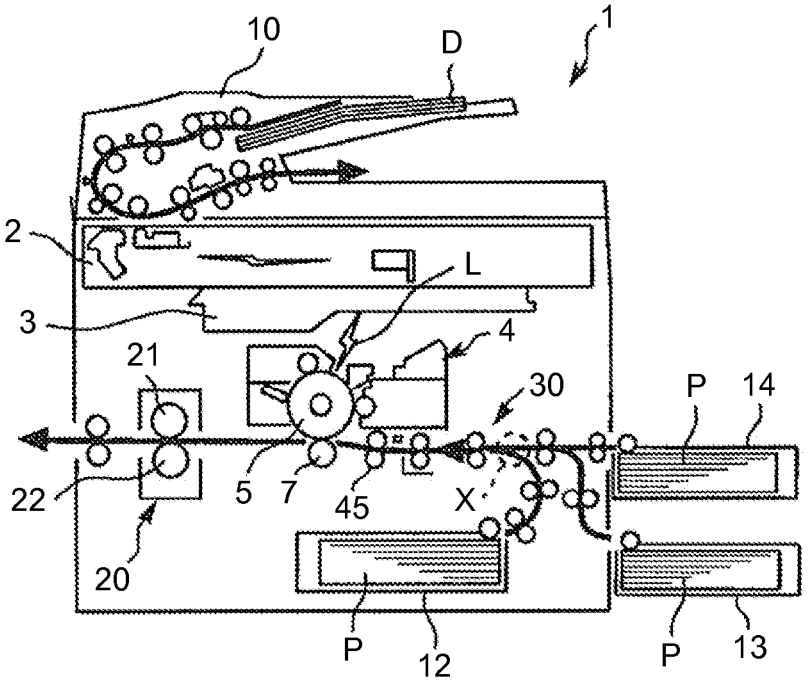
FIG. 1 is a schematic for explaining an exemplary structure of an image forming apparatus according to embodiments of the present invention.

Embodiments for enabling implementations of the present invention will now be explained in detail with reference to the drawings. In the drawings, the same reference numerals are assigned the same parts or equivalent parts, and redundant explanations thereof are simplified or omitted as appropriate.

First Embodiment

To begin with, a structure of and an operation performed by the entire image forming apparatus will be explained with reference to FIG. 1.

In FIG. 1, an image forming apparatus 1 according to a first embodiment of the present invention serves as a copying machine. However, the image forming apparatus 1 may be a similar device such as a printer, a facsimile, a multifunctional peripheral (MFP) including functions of a copier, a printer, and a facsimile, and an offset printer. The image forming apparatus 1 includes a document scanning unit 2 that optically reads image information of a document D; an exposing unit 3 that irradiates a photosensitive drum 5 with exposing light L that is based on the image information read by the document scanning unit 2; an imaging unit 4 that forms a toner image (image) on the photosensitive drum 5; a transfer unit 7 (image forming unit) that transfers the toner image formed on the photosensitive drum 5 onto a recording medium P; a document feeding unit 10 that conveys the document D placed thereon into the document scanning unit 2; and paper feeding units 12 to 14 (paper feeding cassettes) in which recording media P (sheets) such as transfer paper are stored. The image forming apparatus 1 also includes a fixing device 20 that fixes an unfixed image on the recording medium P; a fixing roller 21 provided to the fixing device 20; a pressing roller 22 provided to the fixing device 20; a conveying device 30 that conveys a recording medium P along a conveying path; and registration rollers 45 (timing rollers) for conveying the recording medium P to the transfer unit 7.

An operation performed by the image forming apparatus during a normal image formation will now be explained with reference to FIG. 1.

Carriage rollers provided to the document feeding unit 10 convey the document D placed on a document plate in a direction of the arrow in FIG. 1, and the document D is passed across the document scanning unit 2. At this time, the document scanning unit 2 optically reads image information of the document D passed across the document scanning unit 2.

The optical image information read by the document scanning unit 2 is converted into an electric signal, and the electric signal is transmitted to the exposing unit 3 (writing unit). The exposing unit 3 then irradiates the photosensitive drum 5 included in the imaging unit 4 with the exposing light L (laser beam) that is based on the image information being the electric signal.

In the imaging unit 4, the photosensitive drum 5 is applied with given processes (a charging process, an exposing process, and a developing process) while rotating in the clockwise direction in FIG. 1. In this manner, an image (toner image) corresponding to the image information is formed on the photosensitive drum 5.

The transfer unit 7 serving as an image forming unit then transfers the image formed on the photosensitive drum 5 onto a recording medium P fed by the registration rollers 45.

The recording medium P is carried into the transfer unit 7 (image forming unit) in the manner to be described below with reference to FIGS. 1 and 2.

To begin with, one of the paper feeding units 12 to 14 provided to the image forming image forming apparatus 1 is selected automatically or manually (it is assumed herein that the paper feeding unit 12 provided inside of the image forming apparatus 1 is selected, as an example).

A paper feeding roller 41 then feeds the top sheet of the recording media P stored in the paper feeding unit 12 into a curved conveying path K1 in which a first registration assisting unit 52A is provided.

The recording medium P is then passed through the curved conveying path K1 to the position of a merging point X (a point a conveying path K3 from the paper feeding unit 13 merges with a conveying path K4 from the paper feeding unit 14, both units of which are provided outside of the image forming apparatus 1), and passed through a linear conveying path K2 provided with a registration unit 51. The recording medium P then reaches the position of the registration rollers 45. The recording medium P having reached the position of the registration rollers 45 is conveyed into the transfer unit 7 (image forming unit) at synchronized timing with the image formed on the photosensitive drum 5 so that the recording medium P is positioned correctly with respect to the image formed on the photosensitive drum 5.

After passing through the position of the transfer unit 7, the recording medium P having applied with a transfer process reaches the fixing device 20 via a conveying path. The recording medium P reaching the fixing device 20 is inserted between the fixing roller 21 and the pressing roller 22, and the image on the recording medium P is fixed by the heat applied by the fixing roller 21 and the pressure applied by both of the members 21 and 22. The recording medium P on which the image is fixed is sent out of the nip (nip portion) between the fixing roller 21 and the pressing roller 22, and is discharged out of the image forming image forming apparatus 1.

In this manner, a sequence of the image forming process is completed.

Figure 2:
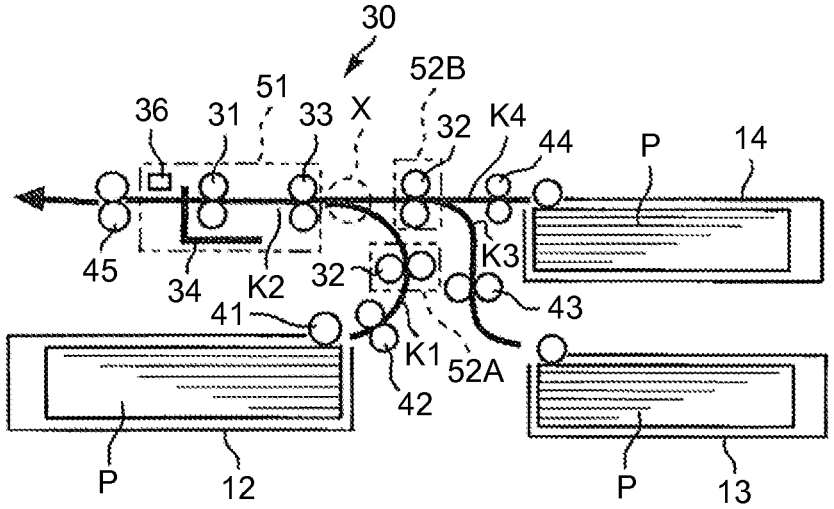
FIG. 2 is a schematic for explaining a structure of a conveying device.

As illustrated in FIG. 2, the image forming apparatus 1 according to the first embodiment has a structure enabled to feed a recording medium P from the three paper feeding units 12 to 14 into the transfer unit 7 (image forming unit).

More specifically, the first paper feeding unit 12 is provided in a lower part of the image forming apparatus 1. The curved conveying path K1 (curving conveying path) curving along a direction in which the recording medium P is conveyed is provided as a conveying path from the first paper feeding unit 12 to the merging point X. The curved conveying path K1 is formed by a curving conveying guide plate not illustrated (provided in a manner nipping the front and the rear surface of the recording medium P being conveyed). The curved conveying path K1 is also provided with a pair of carriage rollers 42 and second nipping rollers 32 (lateral registration correction assisting rollers) along the conveying direction. Each roller pair of the carriage rollers 42 and the second nipping rollers 32 is a roller pair having a driving roller (a roller driven in rotation by a driving mechanism not illustrated) and a driven roller (a roller driven in rotation by a frictional resistance between the driven roller and the driving roller), and conveys the recording medium P while nipping the recording medium P. The second nipping rollers 32 provided to the curved conveying path K1 also function as the registration assisting unit 52A (first registration assisting unit) that aids an operation of correcting a lateral registration, which will be explained in more detail later.

In the first embodiment, the curved conveying path K1 has a curvature radius equal to or smaller than 50 millimeters. Therefore, the distance between the first paper feeding unit 12 and the merging point X (or the registration unit 51) is reduced, and the entire image forming apparatus 1 (conveying device 30) is reduced in size (to more compact).

Both of the second paper feeding unit 13 and the third paper feeding unit 14 are provided outside of the image forming apparatus 1 on one side of the image forming apparatus 1. The conveying path from the second paper feeding unit 13 to the merging point X includes a curved conveying path K3 and a linear conveying path, and is provided with a pair of carriage rollers 43 and the second nipping rollers 32. The conveying path from the third paper feeding unit 13 to the merging point X includes a linear conveying path K4, and is provided with a pair of carriage rollers 44 and the second nipping rollers 32. The curved conveying path K3 and the linear conveying path K4 are formed by a curved conveying guide plate and a linear guide plate (neither one of which is illustrated), respectively. Each roller pair of the pairs of the carriage rollers 43, 44, and the second nipping rollers 32 are a roller pair including a driving roller and a driven roller, and conveys the recording medium P while nipping the recording medium P. The second nipping rollers 32 are provided at a position near the curved conveying path K3, on a linear conveying path provided upstream of the merging point X and shared between the conveying path from the second paper feeding unit 12 to the merging point X and the conveying path from the third paper feeding unit 13 to the merging point X. The second nipping rollers 32 function as a registration assisting unit 52B (second registration assisting unit) for assisting the operation of correcting a lateral registration.

In the first embodiment, the curved conveying path K3 has a curvature radius of equal to or smaller than 50 millimeters. Therefore, the distance between the second paper feeding unit 13 and the merging point X (or the registration unit 51) is reduced, so that the entire image forming apparatus 1 (conveying device 30) is reduced in size (to more compact).

In the first embodiment, the curved conveying path K3 and the linear conveying path K4 are provided inside of the image forming apparatus 1. Alternatively, the curved conveying path K3, the linear conveying path K4, and the two paper feeding units 13 and 14 may be structured integrally as a paper feeding unit (feeding device) that is removable from the image forming apparatus 1. Such a configuration enables the image forming apparatus 1 itself to be further reduced in size.

The linear conveying path K2 having an approximately linear shape along the conveying direction of the recording medium P serves as a conveying path from the merging point X, which is the point where the conveying path from the first paper feeding unit 12 merges with the conveying path from the second paper feeding unit 13 and the third paper feeding unit 14, to the position of the registration rollers 45. The linear conveying path K2 is formed by a linear conveying guide plate (provided in a manner nipping the front and the rear surface of the recording medium P being conveyed) not illustrated. Arranged along the linear conveying path K2 in the conveying direction are feed rollers 33, first nipping rollers 31 (lateral registration correction rollers), an abutting member 34 (stopper member), a contact image sensor (CIS) 36 (detecting unit), and the registration rollers 45. Each roller pair of the feed rollers 33, the first nipping rollers 31, and the registration rollers 45 is a pair of rollers including a driving roller and a driven roller, and conveys the recording medium P while nipping the recording medium P. Members such as the feed rollers 33, the first nipping rollers 31, the abutting member 34, and the CIS 36 provided to the linear conveying path K2 function also as the registration unit 51 that performs a registration operation, e.g., a longitudinal registration correction, a skew correction, and a lateral registration correction, which will be explained more in detail later.

The conveying device 30 which characterizes the first embodiment will now be explained in detail with reference to FIGS. 2 to 4.

Mainly explained below are elements provided along the conveying path from the first paper feeding unit 12 to the registration rollers 45, and elements performed by these structures.

Figure 3:
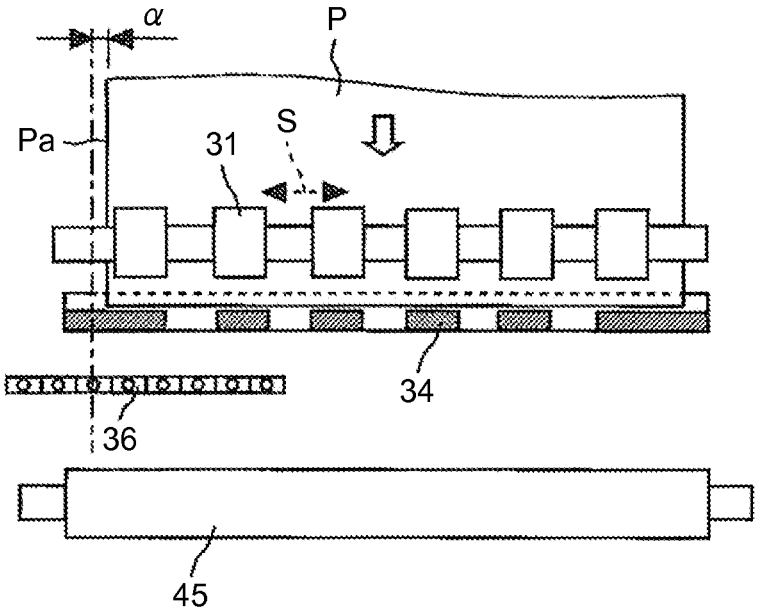
FIG. 3 is a top view illustrating a part of the structure of the conveying device.

Referring to FIGS. 2 and 3, along the path for conveying the recording medium P (the path illustrated with a thick solid line in FIG. 2) through the conveying device 30, the pair of carriage rollers 42 and the second nipping rollers 32 (lateral registration correction assisting rollers) are provided to the curved conveying path K1, and the feed rollers 33, the first nipping rollers 31 (lateral registration correction rollers), the abutting member 34, the CIS 36 serving as a detecting unit, and the registration rollers 45 are provided to the linear conveying path K2.

The abutting member 34 is enabled to be switched between a position for closing the conveying path and a position for opening the conveying path, on the downstream side of the first nipping rollers 31 in the conveying path, at a position relatively near to the first nipping rollers 31.

More specifically, the abutting member 34 is a metal plate having an abutting surface (divided into a plurality of sections along the width direction in the first embodiment) which the leading end of the recording medium P halts against. Longitudinal registration of the recording medium P is corrected when the leading end of the recording medium P halts against the abutting member 34. Skew of the recording medium P is also corrected when the leading end of the recording medium P halts against the abutting member 34. The abutting member 34 is enabled to open and to close the path for conveying the recording medium P. Specifically, the abutting member 34 closes the conveying path by being caused to move up in FIG. 2 to, or opens the conveying path by being caused to move down in FIG. 2 at given timing, driven by a cam mechanism (not illustrated) that is engaged with the abutting member 34.

The feed rollers 33 are provided at a position on an upstream side of the first nipping rollers 31 (upstream side in the conveying direction) and between the second nipping rollers 32 and the first nipping rollers 31. The feed rollers 33 are a pair of carriage rollers enabled to convey the recording medium P by being rotated while nipping the recording medium P, and enabled to be separated from each other so as to be switched between a position at which the recording medium P is nipped and another position at which the recording medium P is released. When the feed rollers 33 conveys the recording medium P by nipping the recording medium P and causes the leading end of the recording medium P to halt against the abutting member 34, conveying time (driving time) is controlled so that the recording medium P is slightly warped (buffering portion corresponding to the part surrounded by a dotted line in (A) of FIG. 4) between the feed rollers 33 and the abutting member 34.

The first nipping rollers 31 are a pair of rollers each divided into a plurality of sub-rollers in the width direction, and arranged on an upstream side of the abutting member 34 in the conveying direction of the recording medium P. The first nipping rollers 31 are enabled to meet each other and to be separated from each other, and to move in the width direction (in the directions of the arrow S illustrated in a dotted line in FIG. 3) by a driving mechanism not illustrated. In other words, the first nipping rollers 31 are enabled to be separated from each other so as to be switched between a position at which the recording medium P is nipped and another position at which the recording medium P is released, and to convey the recording medium P by being rotated. The first nipping rollers 31 correct a lateral registration of the recording medium P by nipping the recording medium P that is in contact with the abutting member 34, and then by being caused to move in the width direction. In other words, the first nipping rollers 31 are enabled to move in the width direction while nipping the recording medium P, and function as a lateral registration correcting unit that corrects a positional deviation of the recording medium P, being conveyed along the conveying path, in the width direction by displacing the recording medium P in the width direction.

The registration rollers 45 are a pair of carriage rollers arranged on the downstream side of the first nipping rollers 31 and the abutting member 34 in the conveying path (downstream side in the conveying direction), and enabled to convey the recording medium P by being rotated while nipping the recording medium. The recording medium P having its lateral registration corrected by the first nipping rollers 31 is conveyed to a position of the registration rollers 45. Once a photosensor (not illustrated, arranged between the registration rollers 45 and the image forming unit) detects the recording medium P nipped between the registration rollers 45, the registration rollers 45 stop carrying the recording medium P. The registration rollers 45 then starts being driven in rotation again so that the recording medium is conveyed into image forming unit at such an adjusted timing that is synchronized with the image formed on the photosensitive drum 5.

The CIS 36 serving as a detecting unit is arranged on the downstream side of the first nipping rollers 31 along the conveying path, and on the upstream side of the registration rollers 45 along the conveying path. The CIS 36 includes a plurality of photosensors (each including a light emitting element such as a light emitting diode (LED) and a light receiving element such as a photodiode) arranged in parallel in the width direction, and detects a positional deviation amount of lateral registration by detecting a side edge (edge portion) Pa on one side of the recording medium P in the width direction. In other words, the CIS 36 (detecting unit) detects, in the conveying path of the conveying device 30, a positional deviation amount in the width direction of the recording medium P being conveyed. Based on a detection result of the CIS 36, the first nipping rollers 31 corrects the lateral registration (or the first nipping rollers 31 and the second nipping rollers 32 correct the lateral registration).

In the first embodiment, as illustrated in FIG. 3, the CIS 36 is provided only on one side in the width direction to detect the position of the side edge Pa of the recording medium P in the width direction. Alternatively, the CIS 36 may be provided across the entire width direction to detect the positions of both side edges of the recording medium P in the width direction.

The second nipping rollers 32 (the first registration assisting unit 52A) and the pair of carriage rollers 42 are provided on the midway along the curved conveying path K1 (curve).

The second nipping rollers 32 are provided at a position on the upstream side of the first nipping rollers 31 in the conveying path, and at a position sufficiently separated from the first nipping rollers 31. The second nipping rollers 32 are enabled to meet each other and to be removed from each other by a driving mechanism not illustrated, and to move in the width direction (the direction perpendicular to the paper surface in FIG. 2). In other words, the second nipping rollers 32 are enabled to be separable from each other and switchable between a position at which the recording medium P is nipped and at which the recording medium P is released, and to convey the recording medium P by being rotated, in the same manner as the first nipping rollers 31. Under a given condition, the second nipping rollers 32 move together with the first nipping rollers 31 in the width direction while nipping the recording medium P to correct the lateral registration of the recording medium P. In other words, the second nipping rollers 32 are configured to be movable in the width direction while nipping the recording medium P, and function as a lateral registration correction assisting unit for correcting positional deviation of the recording medium P in the width direction under a given condition, by displacing the recording medium P being conveyed along the conveying path in the width direction.

The pair of carriage rollers 42 are provided at a position on the upstream side of the second nipping rollers, and is enabled to be separated from each other so as to be switched between a position at which position the recording medium P is nipped and another position at which the recording medium P is released.

The conveying device 30 is provided with a plurality of driving motors (driving mechanisms) so that some of the roller pairs 31 to 33, 42 to 45 can be driven in rotation independently (various driving rotations which will be explained later with reference to FIG. 4).

The conveying device 30 having the structure described above corrects a width-direction positional deviation (lateral registration) of the recording medium P being conveyed along the conveying path, by moving the first nipping rollers 31 and the second nipping rollers 32 in the width direction based on the detection result of the CIS 36 (detecting unit), while the recording medium P is nipped between the first nipping rollers 31 and the second nipping rollers 32.

To explain using a specific example referring to FIG. 3, when the CIS 36 detects a positional deviation of the recording medium P by a distance $\alpha$ toward right in FIG. 3 from a reference position (correct position without any positional deviation) indicated by a long dashed short dashed line, a controlling unit moves the first nipping rollers 31 and the second nipping rollers 32 by the distance $\alpha$ to left in FIG. 3, using the positional deviation amount $\alpha$ as an amount to be corrected, while the recording medium P is nipped between the first nipping rollers 31 and the second nipping rollers 32.

When a recording medium P being conveyed is longer than the distance of the conveying path from the second nipping rollers 32 to the first nipping rollers 31 (for example, a long sheet having a size equal to or longer than 900 millimeters in the conveying direction), the lateral registration is corrected by nipping the recording medium P between the first nipping rollers 31 and the second nipping rollers 32 in the manner described above.

In the first embodiment, when that being conveyed is a recording medium P having a length in the conveying direction being shorter than the distance of the conveying path from the second nipping rollers 32 to the first nipping rollers 31 (for example, a sheet with an A4 lateral size in the conveying direction), a width-direction positional deviation of the recording medium P being conveyed along the conveying path is corrected, by moving the first nipping rollers 31 in the width direction based on the detection result of the CIS 36 (detecting unit), while the recording medium P is nipped solely by the first nipping rollers 31.

When a lateral registration of a recording medium P is corrected in an image forming apparatus 1 (the conveying device 30) that is reduced in size by being provided with a curved conveying path K1 with a curvature radius of equal to or smaller than 50 millimeters, such a structure and such operations can reduce a resistance (conveying resistance) caused by the recording medium P sliding along the curved conveying path K1 while moving in the width direction, even when the trailing end of the recording medium P is positioned in the curved conveying path K1, because the recording medium P is moved in the width direction while a position near the leading end of the recording medium P is nipped between the first nipping rollers 31 and a position near the trailing end (or a position sufficiently distant from the leading end) of the recording medium P is nipped between the second nipping rollers 32. Therefore, the recording medium is rarely carried diagonally (skewed), twisted, or wrinkled by the conveying resistance, and a lateral registration correction can be performed highly accurately. The force at which the recording medium P is nipped (nipping force) between the two pairs of nipping rollers 31 and 32 are set sufficiently larger than the conveying resistance caused by the recording medium P sliding along the curved conveying path K1.

When a recording medium P being conveyed is shorter than the distance of the conveying path from the second nipping rollers 32 to the first nipping rollers 31, the lateral registration is corrected in the linear conveying path K2 where the conveying resistance to the recording medium P is small, without interfering the curved conveying path K1 with the recording medium P. Therefore, the lateral registration can be corrected highly accurately without causing any skew, twists, or wrinkles.

Such controls for correcting a lateral registration are switched based on the size of the recording medium P along the conveying direction. Such switching is performed based on information of the size of a recording medium P that is input to the controlling unit. The input information may be based on information detected by a size sensor directly detecting the size of the recording medium P in the paper feeding unit 12 or in the conveying path from the paper feeding unit 12 to the registration unit 51, or based on information about the recording medium P input via an operation panel (not illustrated) by a user.

Explained so far is an example in which the recording medium P is fed from the first paper feeding unit 12. In a case in which the recording medium P is fed from the second paper feeding unit 13 or from the third paper feeding unit 14 as well, when a recording medium P being conveyed is long in the conveying direction, the lateral registration is corrected by nipping the recording medium P between the first nipping rollers 31 and the second nipping rollers 32.

When the recording medium P is fed from the second paper feeding unit 13 in particular, because the recording medium P is conveyed along the curved conveying path K3 with a curvature radius of equal to or smaller than 50 millimeters, the same advantageous effect explained above can be achieved.

When the recording medium P is fed from the third paper feeding unit 14, although the conveying resistance to the recording medium P is not very large to begin with, because the recording medium P is conveyed along the linear conveying path K4, skew, twists, and wrinkles can be prevented more reliably. Furthermore, because the registration assisting unit 52B (the second nipping rollers 32) is shared between the conveying path from the paper feeding unit 13 and the conveying path from the paper feeding unit 14, costs and the size of the entire apparatus can be reduced.

In the image forming apparatus 1 according to the first embodiment, when every size of acceptable recording media P in the conveying direction is longer than the distance of the conveying path from the second nipping rollers 32 to the first nipping rollers 31, the lateral registration correction is always performed by nipping the recording medium P between the first nipping rollers 31 and the second nipping rollers 32.

In the first embodiment, when the lateral registration is corrected by nipping the recording medium P between the first nipping rollers 31 and the second nipping rollers 32 (or when the lateral registration is corrected by nipping the recording medium P solely by the first nipping rollers 31) in the manner described above, other pairs of carriage rollers facing the recording medium P (pairs of carriage rollers not configured movable in the width direction, such as the feed rollers 33 and the pair of carriage rollers 42) are separated from each other so as not to nip the recording medium P.

In this manner, the lateral registration correction explained above is performed reliably.

Furthermore, in the first embodiment, before the lateral registration is corrected by nipping the recording medium P between the first nipping rollers 31 and the second nipping rollers 32 (or before the lateral registration is corrected by nipping the recording medium P solely by the first nipping rollers 31), the abutting member 34 is moved to close the conveying path while the first nipping rollers 31 are separated from each other so as not to nip the recording medium P, and the leading end of the recording medium P is allowed to halt against the abutting member 34. In this manner, a longitudinal registration (a positional deviation in the conveying direction) and skew (a positional deviation in a direction diagonal to the conveying direction) of the recording medium P are corrected.

In this manner, a longitudinal registration and skew are corrected reliably before the lateral registration is corrected, without being interrupted by the first nipping rollers 31.

Furthermore, in the first embodiment, the CIS 36 (detecting unit) detects a width-direction positional deviation amount of the recording medium P while the first nipping rollers 31 and the second nipping rollers 32 are rotating and carrying the recording medium P, and the lateral registration of the recording medium P is corrected based on the detection result of the CIS 36.

In other words, when the lateral registration is corrected by nipping the recording medium P between the first nipping rollers 31 and the second nipping rollers 32, the lateral registration is corrected while the recording medium P is carried by the first nipping rollers 31 and the second nipping rollers 32 driven in rotation. Furthermore, when the lateral registration is corrected by nipping the recording medium P solely by the first nipping rollers 31, the lateral registration is corrected while the recording medium P is carried by the first nipping rollers 31 driven in rotation.

In this manner, a lateral registration of the recording medium P can be corrected without reducing productivity of the apparatus, compared with when the lateral registration is corrected after the first nipping rollers 31 and the second nipping rollers 32 are stopped being driven in rotation.

Furthermore, in the first embodiment, once the recording medium P having lateral registration corrected is nipped between the registration rollers 45 (pair of carriage rollers), the first nipping rollers 31 are separated from each other so as to release the recording medium P.

In this manner, the registration rollers 45 can convey the recording medium P to the image forming unit reliably, and the registration unit 51 can prepare for an operation to be applied to the next recording medium P fed into the registration unit 51 promptly.

An example of an operation performed by the conveying device 30 having the structure described above will now be explained in detail with reference to FIG. 4.

The operation of the conveying device 30 to be described below is performed when a recording medium P being conveyed is longer than the distance of the conveying path from the second nipping rollers 32 to the first nipping rollers 31.

To begin with, the recording medium P fed from the paper feeding unit 12 is nipped between and carried by the pairs of rollers 42, 32, and 33. The leading end of the recording medium P is then passed along the curved conveying path K1, and reaches the position of the abutting member 34 in the linear conveying path K2 (the operation of conveying the recording medium P in the direction of the arrow in a dotted line). At this time, the first nipping rollers 31 are moved to separate from each other, in the direction in which the conveying path is opened (in the directions of the arrows in solid line). The abutting member 34 is moved in a direction in which the conveying path is closed (the direction of the white arrow; upwardly).

Figure 4:
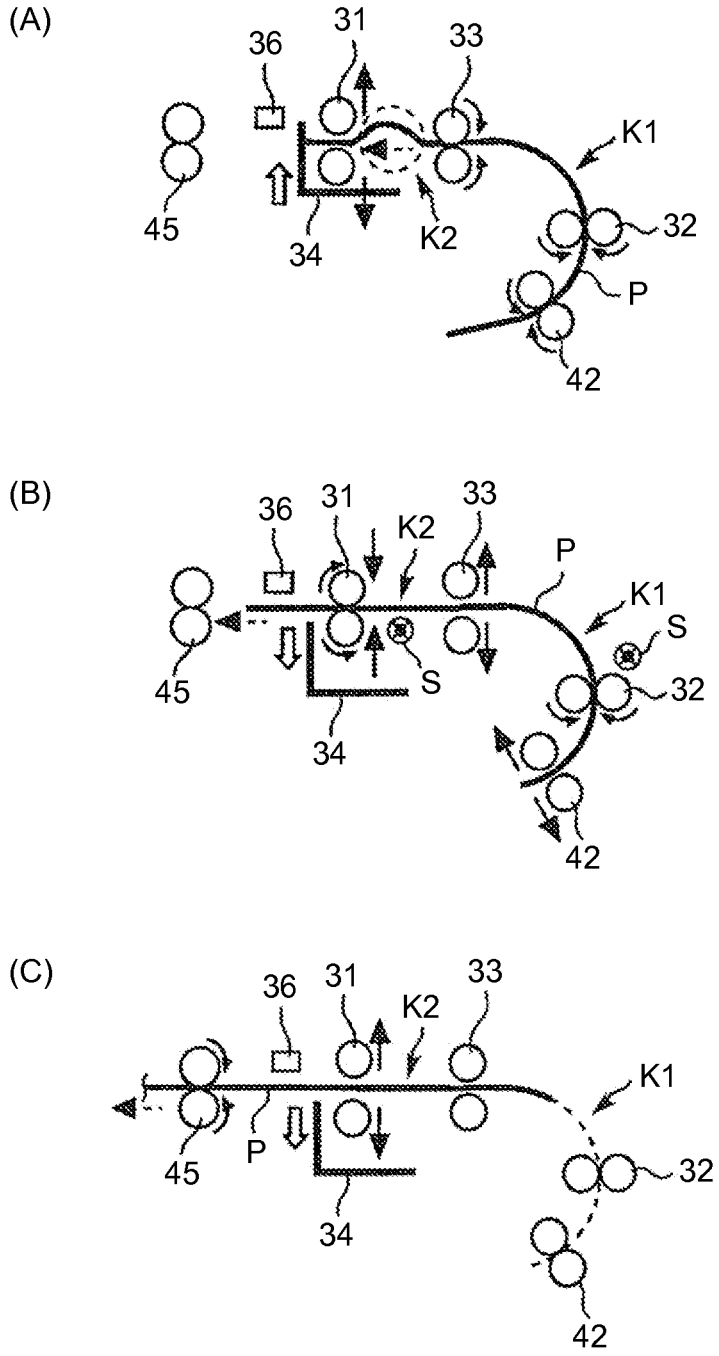
FIG. 4 illustrates operations performed by a conveying device according to a first embodiment of the present invention.

The leading end of the recording medium P is then brought into contact with the abutting member 34, causing the recording medium P to stop, as illustrated in (A) of FIG. 4. At this time, the feed rollers 33 are overrun to cause the recording medium to warp by a given degree (a buffering portion corresponding to the part surrounded by a dotted line in (A) of FIG. 4) between the feed rollers 33 and the abutting member 34.

In this manner, the longitudinal registration of the recording medium P is corrected. Once the positional deviation of the recording medium P in the conveying direction is corrected, the first nipping rollers 31 are driven in rotation, and the recording medium P is carried toward the registration rollers 45.

Because the leading end of the recording medium P halts against the abutting member 34, skew of the recording medium P is also corrected. In other words, even when the recording medium P is conveyed diagonally to the conveying direction (the recording medium P is skewed), one side of the leading end at first halts against the abutting member 34, and the other end then halts against the abutting member 34 about the one side. In this manner, skew of the recording medium P is corrected eventually.

After the longitudinal registration and the skew are corrected by causing the leading end of the recording medium P to halt against the abutting member 34, the recording medium P is nipped and carried by the first nipping rollers 31 and the second nipping rollers 32, as illustrated in (B) of FIG. 4. At this time, the abutting member 34 is moved in the direction in which the conveying path is opened (the direction of the white arrow; downwardly). Each of the feed rollers 33 and the pair of carriage rollers 42 are moved to separate from each other, in the directions in which the conveying path is opened and the recording medium P is released (the direction of the arrows in solid line). The first nipping rollers 31 and the second nipping rollers 32 are then moved in directions in which the conveying path is closed and in which the recording medium P is nipped (the directions of the arrows in solid line), and start being rotated in the direction of the arrows.

The recording medium P is then nipped and carried by the first nipping rollers 31 and the second nipping rollers 32, and the leading end of the recording medium P reaches the position of the CIS 36. The CIS 36 detects a positional deviation amount $\alpha$ of lateral registration at that position. The first nipping rollers 31 and the second nipping rollers 32 are then moved in the width direction (a direction perpendicular to the paper surface (S direction)) synchronously, based on the detection result of the CIS 36. In other words, the CIS 36 detects an amount of lateral registration of the recording medium P, and both of the nipping rollers 31 and 32 are moved in the width direction synchronously (moved in the same direction and by the same moving amount) so as to cancel out the positional deviation amount by that amount. In this manner, the recording medium P is carried toward the registration rollers 45 while the lateral registration is being corrected.

The recording medium P having its lateral registration corrected is then nipped between the registration rollers 45 at their leading ends, and stops temporarily, as illustrated in (C) of FIG. 4. At this time, the first nipping rollers 31 (or the first nipping rollers 31 and other pairs of rollers) having nipped and carried the recording medium P are moved away from each other in the directions in which the recording medium P is released (the direction of the arrows in solid line), and the conveying path is opened.

The registration rollers 45 then start being driven in rotation in a manner synchronized with the image on the photosensitive drum 5, causing the recording medium P to be carried toward the transfer unit 7 (image transfer unit). As a result, the image is transferred onto a desired position on the recording medium P.

The conveying device 30 having the structure and operating in the manner described above may be configured to move the second nipping rollers 32 in the width direction based on the detection result of the CIS 36 (detecting unit) at a lower precision than the precision at which the first nipping rollers 31 are moved in the width direction based on the detection result of the CIS 36. In other words, the conveying device 30 may be configured to allow the first nipping rollers 31 to perform the lateral registration correction at a higher precision than that performed by the second nipping rollers 32.

This is because, when the lateral registration of the recording medium P is corrected by nipping the recording medium P between the first nipping rollers 31 and the second nipping rollers 32 in the manner described above, while the entire precision is largely affected by the precision of the lateral registration correction achieved by the first nipping rollers 31, the lateral registration correction achieved by the second nipping rollers 32 is subsidiary and does not require the same level of corrective precision.

Such a configuration enables a less expensive motor to be used as a driving motor provided to the mechanism for moving the second nipping rollers 32 in the width direction, for example, so that costs of the entire apparatus can be reduced.

As explained above, in the first embodiment, the second nipping rollers 32 are provided on the upstream side of the first nipping rollers 31, and a lateral registration is corrected by moving the first nipping rollers 31 and the second nipping rollers 32 in the width direction based on a lateral positional deviation amount detected by the CIS 36 (detecting unit), while the recording medium P is nipped between the first nipping rollers 31 and the second nipping rollers 32. In this manner, a lateral registration can be corrected highly accurately without causing any defect such as skew of the recording medium P caused by a conveying resistance, and without increasing the size of the apparatus.

Second Embodiment

An exemplary operation of the conveying device that is different from that according to the first embodiment will now be explained. Because the structures of the image forming apparatus and the conveying device are the same as those according to the first embodiment, the same reference numerals are assigned, and redundant explanations thereof are omitted hereunder. An operation performed by a conveying device according to a second embodiment of the present invention will now be explained.

In the second embodiment, the conveying device is controlled to be switched, depending on the thickness of a recording medium P being conveyed (thickness of the sheet), between an operation for correcting a width-direction positional deviation of the recording medium P by moving the first nipping rollers 31 and the second nipping rollers 32 in the width direction based on the detection result of the CIS 36 (detecting unit) while the recording medium P is nipped between the first nipping rollers 31 and the second nipping rollers 32, and an operation for correcting a width-direction positional deviation of the recording medium P by moving the first nipping rollers 31 in the width direction based on the detection result of the CIS 36 while the recording medium P is nipped between the first nipping rollers 31 and while the second nipping rollers 32 are separated from each other (while the recording medium P is nipped solely by the first nipping rollers 31) even when a recording medium P being conveyed is longer than the distance of the conveying path from the second nipping rollers 32 to the first nipping rollers 31 (for example, a long sheet having a size of 900 millimeters or more in the conveying direction).

More specifically, when the recording medium P being conveyed is thicker than a predetermined thickness (for example, when passed is a recording medium P having a basis weight of more than 64 g/m$^2$), the conveying device performs the operation for correcting a width-direction positional deviation of the recording medium P by moving the first nipping rollers 31 and the second nipping rollers 32 in the width direction based on the detection result of the CIS 36, while the recording medium P is nipped between the first nipping rollers 31 and the second nipping rollers 32. By contrast, when the thickness of the recording medium P being conveyed is equal to or less than the predetermined thickness (for example, when passed is a thin sheet (recording medium P) having a basis weight equal to or less than 64 g/m$^2$), the conveying device performs the operation for correcting a width-direction positional deviation of the recording medium P by moving the first nipping rollers 31 in the width direction based on the detection result of the CIS 36, while the recording medium P is nipped between the first nipping rollers 31 and while the second nipping rollers 32 are separated from each other (while the recording medium P is nipped solely by the first nipping rollers 31), (at this time, the second nipping rollers 32 are separated).

When the recording medium P being conveyed is a thin sheet, the lateral registration is corrected solely by the first nipping rollers 31, instead of using both of the nipping rollers 31 and 32, because, if a lateral registration is corrected by nipping the leading end and the trailing end of a recording medium P (thin sheet) being thin and weak by the nipping rollers 31 and 32, the recording medium P might get twisted, and might result in a wrinkle or a streak. Furthermore, because only a small resistance (conveying resistance) is produced by a thin and weak recording medium P (thin sheet) to begin with when the recording medium P is slid along the curved conveying path K1 and defects, such as skew, rarely occur, and the lateral registration can be corrected highly accurately even when the lateral registration is corrected using only the first nipping rollers 31.

The control of switching the lateral registration correction depending on the thickness of the recording medium P (thickness of the sheet) is performed based on information related to the thickness of the recording medium P that is input to the controlling unit. The input information may be based on information detected by a thickness sensor directly detecting the thickness of the recording medium P in the conveying path from the paper feeding unit 12 or from the paper feeding unit 12 to the registration unit 51, or based on information about the recording medium P input via an operation panel (not illustrated) by a user.

When a recording medium P being conveyed is shorter than the distance of the conveying path from the second nipping rollers 32 to the first nipping rollers 31, a lateral registration correction is performed using only the first nipping rollers 31, in the manner described above, regardless of the thickness of the recording medium P.

Explained so far is an example in which the recording medium P is fed from the first paper feeding unit 12. In a case in which the recording medium P is fed from the second paper feeding unit 13 or from the third paper feeding unit 14 as well, when a recording medium P being conveyed is long in the conveying direction and is not a thin sheet, the lateral registration is corrected by nipping the recording medium P between the first nipping rollers 31 and the second nipping rollers 32.

When the recording medium P is fed from the second paper feeding unit 13 in particular, because the recording medium P is conveyed along the curved conveying path K3 with a curvature radius of equal to or smaller than 50 millimeters, the same advantageous effect explained above can be achieved.

When the recording medium P is fed from the third paper feeding unit 14, because the recording medium P is conveyed through the linear conveying path K4, the conveying resistance imposed on the recording medium P is not very large to begin with. Therefore, the recording medium P is rarely skewed, twisted, or wrinkled.

In the image forming apparatus 1 according to the second embodiment, when every size of the acceptable recording medium P in the conveying direction is longer than the distance of the conveying path from the second nipping rollers 32 to the first nipping rollers 31, the conveying device is switched between the operation for correcting the lateral registration by nipping the recording medium P between the first nipping rollers 31 and the second nipping rollers 32, and the operation for correcting the lateral registration by nipping the recording medium P solely by the first nipping rollers 31, based on the thickness of the recording medium P, regardless of the size of the recording medium P.

In the second embodiment, when the lateral registration is corrected by nipping the recording medium P between the first nipping rollers 31 and the second nipping rollers 32 (or when the lateral registration is corrected by nipping the recording medium P solely by the first nipping rollers 31) in the manner described above, other pairs of carriage rollers facing the recording medium P (pairs of carriage rollers not configured movable in the width direction, such as the feed rollers 33 and the pair of carriage rollers 42) are separated from each other so as not to nip the recording medium P. When a recording medium P being conveyed is a thin sheet that is long in the conveying direction, the second nipping rollers 32 are also separated from each other so as not to nip the recording medium P.

In this manner, the lateral registration correction explained above is performed reliably.

Furthermore, in the second embodiment, before the lateral registration is corrected by nipping the recording medium P between the first nipping rollers 31 and the second nipping rollers 32 (or before the lateral registration is corrected by nipping the recording medium P solely by the first nipping rollers 31), the abutting member 34 is moved so that the conveying path is closed while the first nipping rollers 31 are separated from each other so as not to nip the recording medium P. The leading end of the recording medium P is then caused to halt against the abutting member 34. In this manner, a longitudinal registration (a positional deviation in the conveying direction) and skew (a positional deviation in a direction diagonal with respect to the conveying direction) of the recording medium P are corrected.

In this manner, a longitudinal registration and skew are corrected reliably before the lateral registration is corrected, without being interrupted by the first nipping rollers 31.

Furthermore, in the second embodiment, the CIS 36 (detecting unit) detects a width-direction positional deviation amount of the recording medium P while the first nipping rollers 31 and the second nipping rollers 32 are rotating and carrying the recording medium P, and the lateral registration of the recording medium P is corrected based on the detection result of the CIS 36.

In other words, when the lateral registration is corrected by nipping the recording medium P between the first nipping rollers 31 and the second nipping rollers 32, the lateral registration is corrected while the recording medium P is carried by the first nipping rollers 31 and the second nipping rollers 32 that are driven in rotation. Furthermore, when the lateral registration is corrected by nipping the recording medium P solely by the first nipping rollers 31, the lateral registration is corrected while the recording medium P is carried by the first nipping rollers 31 driven in rotation.

In this manner, the lateral registration of the recording medium P can be corrected without reducing productivity of the apparatus, compared with when the lateral registration is corrected after the first nipping rollers 31 and the second nipping rollers 32 are stopped being driven in rotation.

Furthermore, in the second embodiment, once the recording medium P having its lateral registration corrected is nipped by the registration rollers 45, the first nipping rollers 31 are separated from each other so that the first nipping rollers 31 is kept away from the recording medium P.

In this manner, the pair of registration rollers 45 can convey the recording medium P into the image forming unit reliably, and the registration unit 51 can prepare for an operation to be applied to the next recording medium P fed into the registration unit 51 promptly.

An example of an operation performed by the conveying device 30 will now be explained in detail with reference to FIG. 5.

The operation of the conveying device 30 to be described below is performed when a recording medium P being conveyed is longer than the distance of the conveying path from the second nipping rollers 32 to the first nipping rollers 31, and is a recording medium P (thin sheet) having a thickness equal to or less than a predetermined thickness.

To begin with, the recording medium P fed from the paper feeding unit 12 is nipped between and carried by the pairs of rollers (the pair of carriage rollers 42, the second nipping rollers 32, the feed rollers 33). The leading end of the recording medium P is then passed along the curved conveying path K1, and reaches the position of the abutting member 34 in the linear conveying path K2 (the operation of conveying the recording medium P in the direction of the arrow in a dotted line). At this time, the first nipping rollers 31 are moved to separate from each other, in the direction in which the conveying path is opened (in the directions of the arrows in solid line). The abutting member 34 is moved in the direction in which the conveying path is closed (the direction of the white arrow; upwardly).

Figure 5:
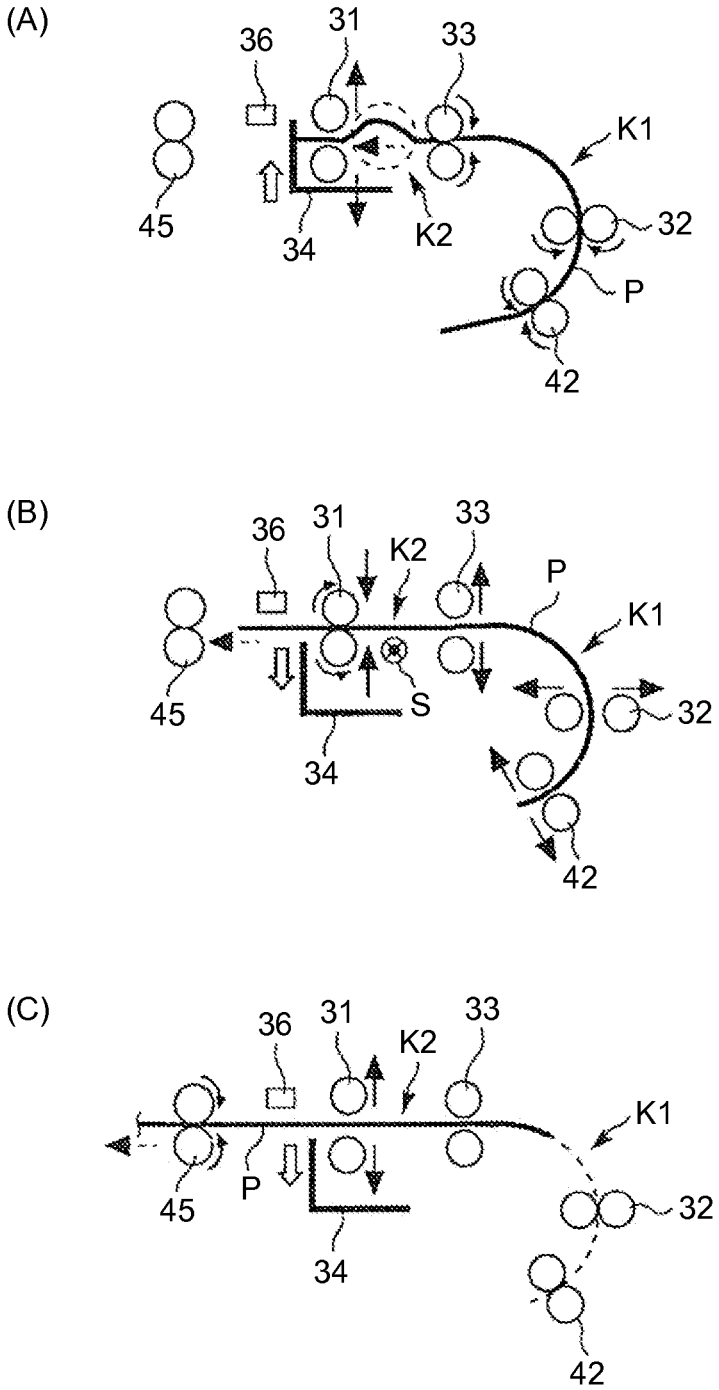
FIG. 5 illustrates operations performed by a conveying device according to a second embodiment of the present invention.

The leading end of the recording medium P is then brought into contact with the abutting member 34, causing the recording medium P to stop, as illustrated in (A) of FIG. 5. At this time, the feed rollers 33 are overrun to cause the recording medium to warp by a given degree (a buffering portion corresponding to the part surrounded by the dotted line in (A) of FIG. 5) between the feed rollers 33 and the abutting member 34.

In this manner, the longitudinal registration of the recording medium P is corrected. Once the positional deviation of the recording medium P in the conveying direction is corrected, the first nipping rollers 31 are driven in rotation, and the recording medium P is carried toward the registration rollers 45.

Because the leading end of the recording medium P halts against the abutting member 34, skew of the recording medium P is also corrected. In other words, even when the recording medium P is conveyed diagonally to the conveying direction (the recording medium P is skewed), one side of the leading end is at first caused to halt against the abutting member 34, and the other end is then caused to halt against the abutting member 34 about the one side. In this manner, skew of the recording medium P is corrected eventually.

After the longitudinal registration and the skew are corrected by causing the leading end of the recording medium P to halt against the abutting member 34, the recording medium P having its longitudinal registration and skew corrected is nipped and carried solely by the first nipping rollers 31, as illustrated in (B) of FIG. 5. At this time, the abutting member 34 is moved in the direction in which the conveying path is opened (the direction of the white arrow; downwardly). The feed rollers 33, the pair of carriage rollers 42, and the second nipping rollers 32 are moved to separate from each other in the directions in which the conveying path is opened and the rollers are removed from the recording medium P (the direction of the arrows in solid line). The first nipping rollers 31 are then moved in directions in which the conveying path is closed and the recording medium P is nipped (the direction of the arrows in solid line), and start being rotated in the direction of the arrows.

The recording medium P is then nipped and carried by the first nipping rollers 31, and the leading end of the recording medium P reaches the position of the CIS 36. The CIS 36 detects a lateral positional deviation amount $\alpha$ at that position. The first nipping rollers 31 are then moved in the width direction (a direction perpendicular to the paper surface (S direction)), based on the detection result of the CIS 36. In other words, the CIS 36 detects an amount of the lateral registration of the recording medium P, and the first nipping rollers 31 are moved in the width direction so as to cancel out the error by that amount. In this manner, the recording medium P (thin sheet) is carried toward the registration rollers 45 while the lateral registration is being corrected.

The leading end of the recording medium P having its lateral registration corrected is then nipped between the registration rollers 45, and stops temporarily, as illustrated in (C) of FIG. 5. At this time, the first nipping rollers 31 (or the first nipping rollers 31 and other pairs of rollers) nipping and carrying the recording medium P are moved away from each other in the directions in which the recording medium P is released (the direction of the arrows in solid line), and the conveying path is opened.

The registration rollers 45 then start being driven in rotation in a manner synchronized with the image on the photosensitive drum 5, causing the recording medium P to be carried toward the transfer unit 7 (image transfer unit). As a result, the image is transferred onto a desired position on the recording medium P.

As explained above, in the second embodiment, the second nipping rollers 32 are provided on the upstream side of the first nipping rollers 31, and, depending on the thickness of the recording medium P being conveyed, the conveying device is switched between an operation for correcting a lateral registration by moving the first nipping rollers 31 and the second nipping rollers 32 in the width direction based on the lateral positional deviation amount detected by the CIS 36 (detecting unit) while the recording medium P is nipped between the first nipping rollers 31 and the second nipping rollers 32, and an operation for correcting a lateral registration by moving the first nipping rollers 31 in the width direction based on the lateral positional deviation amount detected by the CIS 36 while the recording medium P is nipped between the first nipping rollers 31 and the second nipping rollers 32 are separated from each other. In this manner, a lateral registration can be corrected highly accurately regardless of the thickness of the recording medium P being conveyed, without causing any defect such as skew of the recording medium P caused by a conveying resistance, and without increasing the size of the apparatus.

In the first and the second embodiments explained above, the present invention is applied to a conveying device 30 provided to a monochromatic image forming apparatus 1, but may also be applied to a conveying device provided to a color image forming apparatus.

Furthermore, in the embodiments, the present invention is applied to a conveying device 30 provided to an electrophotographic image forming apparatus 1, but an application of the present invention is not limited thereto, and the present invention may be applied to any conveying device that performs a lateral registration correction, including those provided to other types of image forming apparatuses (such as inkjet image forming apparatuses and offset printers).

In such configurations as well, the same advantageous effects achieved in the embodiments can be achieved.

Furthermore, in the embodiments, the present invention is applied to a conveying device 30 arranged at a position on the upstream side of the registration rollers 45 in the conveying direction, but an application of the present invention is not limited thereto, and the present invention may be applied to a conveying device arranged at any other positions, as long as the conveying device performs a lateral registration correction.

Furthermore, in the embodiments, the present invention is applied to a conveying device 30 in which the two conveying paths merge at the merging point X. However, the present invention may also be applied a conveying device in which three or more conveying paths merge at the merging point X, or to a conveying device including only one conveying path without the merging point X.

In such configurations as well, the same advantageous effects achieved in the embodiments can be achieved.

Furthermore, in the embodiments, the conveying device 30 is provided with eight pairs of rollers 31 to 33, 42 to 45, but may also be provided with more pairs of rollers, or with less pairs of rollers. In such configurations, at least two pairs of a plurality of pairs of rollers serve as the first nipping rollers 31 and the second nipping rollers 32. Furthermore, the conveying device 30 may perform operations that are different from those performed by the conveying device 30 and explained with reference to FIGS. 4 and 5, depending on the condition of the recording medium P conveyed along the conveying path (e.g., the second nipping rollers 32 may be caused to be separated from each other, or various pairs of rollers may be brought into contact or separated from each other at different timing).

In such configurations as well, the same advantageous effects achieved in the embodiments can be achieved.

The "width direction" herein is defined as a direction perpendicular to the direction in which the recording medium is conveyed.

According to the embodiments, the second nipping rollers are provided on the upstream side of the first nipping rollers, and a lateral registration is corrected by moving first nipping rollers the second nipping rollers in the width direction based on the positional deviation amount of lateral registration detected by the detecting unit, while the recording medium is nipped between the first nipping rollers and the second nipping rollers. Therefore, it is possible to provide a conveying device and an image forming apparatus that can correct a lateral registration highly accurately without any defect such as skew of a recording medium caused by a conveying resistance, as well as without increasing the size of the apparatus, advantageously.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A conveying device for conveying a recording medium along a conveying path, the conveying device comprising:

a pair of first nipping rollers configured to be movable in a width direction while nipping the recording medium, and rotate to convey the recording medium;

a pair of second nipping rollers configured to be movable in the width direction while nipping the recording medium, and rotate to convey the recording medium, the pair of second nipping rollers being arranged on an upstream side of the first nipping rollers in the conveying path; and a detecting unit configured to detect an amount of positional deviation in the width direction of the recording medium being conveyed in the conveying path; and a controlling unit configured to correct lateral registration of the recording medium by controlling the conveying device to switch between a first operation and a second operation based on a thickness of the recording medium, in the first operation, the pair of first nipping rollers and the pair of second nipping rollers being moved in the width direction based on a detection result of the detecting unit while the pair of first nipping rollers and the pair of second nipping rollers nip the recording medium, so that a positional deviation of the recording medium in the width direction is corrected, and in the second operation, the pair of first nipping rollers is moved in the width direction is moved based on the detection result of the detecting unit while the pair of first nipping rollers nips the recording medium and the second nipping rollers are separated from each other, so that the positional deviation of the recording medium in the width direction is corrected.

2. The conveying device according to claim 1, wherein the first operation is performed if the recording medium is thicker than a predetermined thickness, and the second operation is performed if the recording medium is equal to or thinner than the predetermined thickness.

3. The conveying device according to claim 1, wherein if the recording medium is shorter than a distance in the conveying path between the pair of second nipping rollers and the pair of first nipping rollers, the second operation is performed.

4. The conveying device according to claim 1, further comprising:

a pair of carriage rollers configured to rotate to convey the recording medium while nipping the recording medium, and be separable from each other so that a state of the pair of carriage rollers is switched between a state of nipping the recording medium and a state of not nipping the recording medium, the pair of carriage rollers being arranged in at least one of a position on an upstream side of the pair of second nipping rollers, a position between the pair of second nipping rollers and the pair of first nipping rollers, and a position on a downstream side of the pair of first nipping rollers, wherein the carriage rollers are separated from each other not to nip the recording medium when the positional deviation of the recording medium in the width direction is corrected.

5. The conveying device according to claim 1, further comprising:

an abutting member configured to be movable so that a state of the abutting member is switched between a state in which the conveying path is closed and a state in which the conveying path is opened in a position near the pair of first nipping rollers on a downstream side of the pair of first nipping rollers in the conveying path, wherein the first nipping rollers are separable from each other so that a state of the pair of first nipping rollers is switched between a state of nipping the recording medium and a state of not nipping the recording medium, and before the positional deviation of the recording medium in the width direction is corrected, the abutting member is moved to close the conveying path while the first nipping rollers are separated from each other not to nip the recording medium, to cause a leading end of the recording medium to halt against the abutting member so that at least one of a positional deviation of the recording medium in a conveying direction and a positional deviation of the recording medium diagonal with respect to the conveying direction is corrected.

6. The conveying device according to claim 1, wherein the detecting unit is arranged on a downstream side of the pair of first nipping rollers in the conveying path, and the detecting unit detects the amount of positional deviation in the width direction of the recording medium while the pair of first nipping rollers and the pair of second nipping rollers are being rotated to convey the recording medium or while the pair of first nipping rollers is being rotated to convey the recording medium, so that the positional deviation of the recording medium in the width direction is corrected based on a detection result of the detecting unit.

7. The conveying device according to claim 1, further comprising:

a pair of carriage rollers configured to rotate to convey the recording medium while nipping the recording medium, the pair of carriage rollers being arranged in a position on a downstream side of the pair of first nipping rollers in the conveying path, wherein the first nipping rollers are separable from each other so that a state of the pair of first nipping rollers is switched between a state of nipping the recording medium and a state of not nipping the recording medium, and after the positional deviation of the recording medium in the width direction is corrected, the first nipping rollers are separated from each other not to nip the recording medium when the pair of carriage rollers nips the recording medium.

8. The conveying device according to claim 1, wherein the pair of first nipping rollers is arranged in a linear conveying path having a linear shape along the conveying direction, and the pair of second nipping rollers is arranged in a curved conveying path having a curved shape along the conveying direction or arranged near the curved conveying path.

9. The conveying device according to claim 8, wherein the curved conveying path has a curvature radius of equal to or smaller than 50 millimeters.

10. An image forming apparatus comprising the conveying device according to claim 1.

* * * * *